United States Patent [19]

Wijbenga

[11] Patent Number: 4,507,717

[45] Date of Patent: Mar. 26, 1985

[54] LUMINAIRE FOR STREET LIGHTING

[75] Inventor: Hendrik Wijbenga, Eindhoven, Netherlands

[73] Assignee: U.S. Philips Corporation, New York, N.Y.

[21] Appl. No.: 280,393

[22] Filed: Jul. 6, 1981

[30] Foreign Application Priority Data

Jul. 28, 1980 [NL] Netherlands ..... 8004311

[51] Int. Cl.[3] ..... F21V 3/00

[52] U.S. Cl. ..... 362/304; 362/145; 362/223; 362/307; 362/310; 362/431; 362/348; 362/350

[58] Field of Search ..... 362/145, 217, 223, 296, 362/297, 310, 342, 347, 348, 350, 431, 304, 305, 307

[56] References Cited

U.S. PATENT DOCUMENTS

| | | | |
|---|---|---|---|
| 1,610,124 | 12/1926 | Godley | 362/304 X |
| 2,600,514 | 6/1952 | Mitchell | 362/350 |
| 3,265,883 | 8/1966 | Tolbert | 362/346 |
| 3,283,140 | 11/1966 | Rex | 362/350 X |
| 3,480,772 | 11/1969 | Gough | 362/350 X |
| 3,610,915 | 10/1971 | Moore | 362/347 X |
| 3,786,248 | 1/1974 | Compton | 362/296 |
| 4,234,912 | 11/1980 | Barnes et al. | 362/145 |
| 4,239,369 | 12/1980 | English et al. | 362/348 |
| 4,242,727 | 12/1980 | de Vos et al. | 362/346 |
| 4,285,034 | 8/1981 | Sullivan | 362/350 X |
| 4,378,583 | 3/1983 | Caprari | 362/305 X |

*Primary Examiner*—Peter A. Nelson
*Attorney, Agent, or Firm*—Robert S. Smith

[57] ABSTRACT

According to the invention the luminaire, which is suitable for use with an elongate cylindrical light source, has a dish-shaped reflector with an egg-shaped light emanating face. The reflector mainly comprises a number of elongate facets which are each curved concave longitudinally and transversely and which extend with their longitudinal sides substantially parallel to the light emanating face.

The luminaire gives the illuminated road surface a very uniform luminance.

2 Claims, 7 Drawing Figures

LUMINAIRE FOR STREET LIGHTING

The invention relates to a luminaire for street lighting comprising both a reflector system having a plane of symmetry and a light-emanating face, and a lamp holder for receiving an elongate substantially cylindrical lamp in said plane of symmetry and along said light-emanating face, the reflector system having a reflecting surface at least the major part of which comprises elongate facets extending with their longitudinal sides substantially parallel to the light-emanating face. Such a luminaire for use in street lighting and having a high-pressure discharge lamp as a light source is known from German Offenlegungsschrift No. 19 04 982.

Formerly discharge lamps were used in street lighting luminaires in which the discharge vessels were surrounded by an opalescent, outer envelope. In those cases the outer envelope was coated with a light scattering layer in the case of a high-pressure sodium discharge lamp, or with a luminescent layer in the case of a high-pressure mercury discharge lamp. Optically, these lamps had the shape and the dimensions of the outer envelope: a comparatively large diameter and a comparatively small length/diameter ratio of, for example, 2:1.

Nowadays, however, high-pressure sodium discharge lamps and metal halide discharge lamps are used. The sodium discharge lamp avoids the loss of light caused by a light scattering layer, because such lamps have transparent outer envelope. The high-pressure metal halide discharge lamps, also have a transparent outer envelope, due to the higher efficiency of said lamps compared with high-pressure mercury discharge lamps. Optically, the halide lamps at least to an approximation, have the shape and the dimensions of the discharge space, that is to say a comparatively small diameter and a comparatively large length/diameter ratio of, for example, 5:1. The quasi-linearity of these elongate light sources involves that their positioning in a reflector is critical if the concentrating action of the reflector is to be used optimally. As a result of this it is the more disadvantageous that the discharge vessel of the said lamps as a rule is not mounted coaxially with the lamp cap in the outer envelope. Particularly when high-pressure sodium lamps are used, the discharge tubes of which generally have a diameter from only 5 to 10 mm and an approximately 10-fold length, the correct positioning in a reflector presents problems.

In street lighting it is of importance that a maximum area of the road surface on either side of the luminaire is illuminated uniformly without causing dazzling. This is possible with a continuously curved bright mirror, but in this case the light source should be positioned very accurately and the mirror must have no defects. For practical application such a mirror is not to be considered. Defects of the shape of the mirror and deviations in the positioning of a lamp could at least partly be compensated for by using a mirror having a frosted surface. However, frosting cannot be provided in a sufficiently reproducible manner.

The construction according to the German Offenlegungsschrift cited in the opening paragraph gives some improvement of the uniformity of the road surface lighting in that the reflector system consists of mirrors arranged on either side of the lamp and bent in a plane extending perpendicularly to the light emanating face, said mirrors being bent along lines extending substantially parallel to the light emanating face so as to form elongate facets each situated in a flat plane.

It is the object of the invention to provide a luminaire which, when used for street lighting, gives the illuminated road surface a reasonably even luminance without any sharp discontinuities, even if an elongate cylindrical light source is used therein which is not positioned accurately.

This object is achieved with a luminaire of the kind mentioned in the opening paragraph in that the reflector system comprises a dish-shaped reflector the light-emanating face of which is substantially egg-shaped and whose facets are curved concave longitudinally and transversely, the width of said facets and their radius of transverse curvature being larger near the light-emanating face.

The luminaire according to the invention is intended for being accommodated on the side of the road with the egg-shaped light emanating face having its more pointed end directed towards the other side of the road and either parallel to the surface of the road or enclosing a small angle therewith, for example an angle of 5° to 10°. The plane of symmetry of the reflector is transverse to the longitudinal direction of the road.

The luminaire has the advantage that the reflector is very rigid due to its dish-shape and can withstand considerable forces without changing its shape. From a light technical point of view the luminaire has the advantage that the reflector, due to its concave facets, has a strong light scattering effect so that even in the case of inaccurate positioning of the light source a very uniform luminance is nevertheless given to the illuminated road surface and dazzling is prevented.

It is advantageous from the point of view of the luminance and the uniformity of the luminance of the illuminated road surface, if the dish-shaped reflector is proportioned so that the depth of the dish-shaped reflector is from 0.4 to 0.7 times the largest dimension of the egg-shaped light emanating face measured transverse to the plane of symmetry.

It has proved possible to shape the egg-shaped light-emanating face and the longitudinal sides of the facets according to arcs of a circle and also to curve the concave facets transversely according to arcs of a circle.

In an embodiment the facets approach with their longitudinal sides the light emanating face of the reflector at an ever increasing angle going from the said largest transverse dimension of the egg-shaped light emanating face towards the blunt end of said face. With this measure it is achieved that the luminance of the road surface at medium large distance from the plane of symmetry of the reflector on either side is increased so that the luminance of the illuminated part of the road becomes even more uniform.

In a further embodiment especially suitable to illuminate broader roads the facets of the reflector, curved longitudinally and transversely, extend, in a sector situated at the blunt end of the light emanating face, with their longitudinal sides parallel to the plane of symmetry of the reflector. With this measure the light on the side of the road opposite to the luminaire is better spread and hence the uniformity of the luminance of said part of the road surface is increased.

Embodiments of the luminaire according to the invention are shown in the drawing. In the drawing FIG. 1 is a perspective view of a luminaire, FIG. 2 is a perspective view of the luminaire of FIG. 1 accommodated on the side of a road, FIG. 3 is an underneath view of a first reflector, FIG. 4 is an underneath view of a second reflector.

Figure 1:
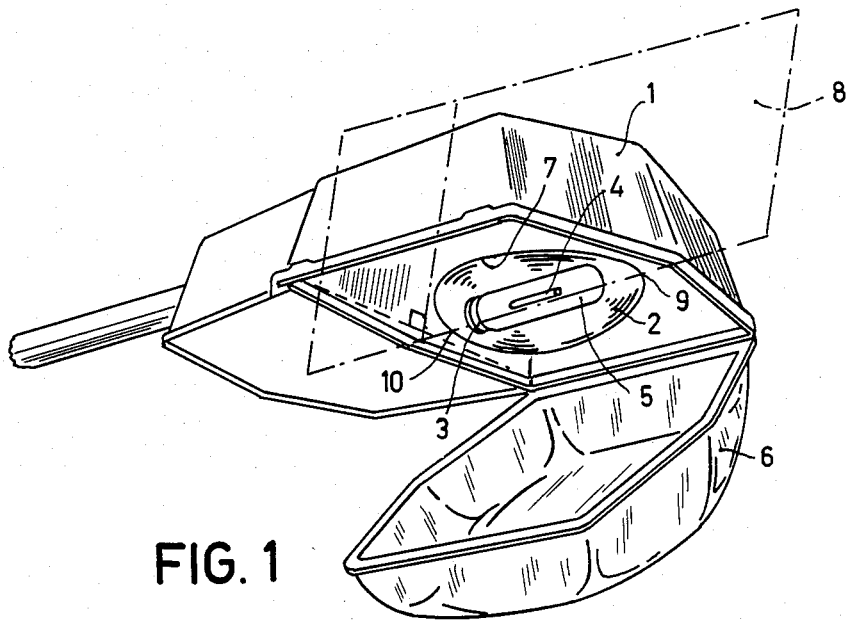

FIG. 1 is a perspective view of a luminaire according to the invention in which a housing 1 has a reflector 2 with a lamp holder 3 and an elongate cylindrical light source 4 in a transparent outer envelope 5. The luminaire can be closed by means of a transparent hood 6. The lower edge 7 of the reflector 2 bounds the light emanating face thereof.

The light source 4 is situated in the plane of symmetry 8 of the reflector 2 and is substantially parallel to the light emanating face bounded by the lower edge 7. The light emanating face bounded by the lower edge 7 is egg-shaped and has a pointed end 9 and a blunt end 10.

Figure 2:
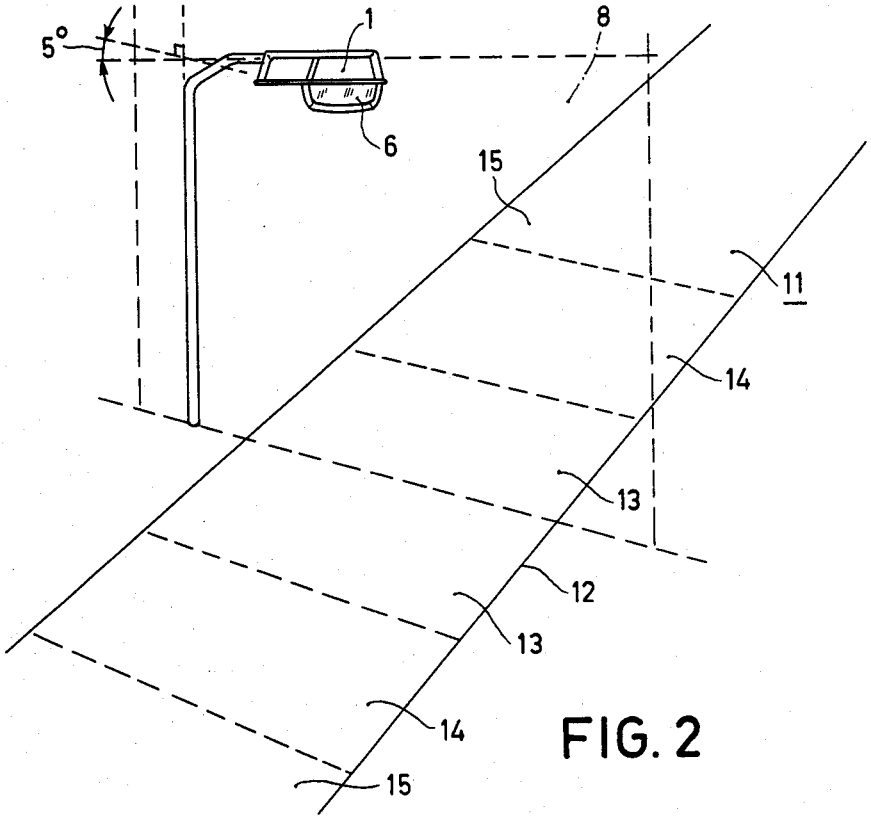

In FIG. 2 the luminaire 1,6 of FIG. 1 is accommodated on the side of a road 11. The plane of symmetry of the reflector 2 is transverse to the longitudinal direction of the road. The pointed end 9 of the light emanating face of the reflector 2 (FIG. 1) is directed towards the opposite side 12 of the road 11.

Referrence numeral 13 denotes zones of the road surface which are situated immediately beside the plane of symmetry 8, zones which are situated at a medium distance are referenced 14, whereas reference numeral 15 denotes zones which are situated at a relatively large distance from said plane 8.

The light emanating face of the reflector 2 includes an angle of 5° with the surface 11 of the road and is directed upwards towards the opposite side 12 of the road. The pointed end 9 (FIG. 1) of the light emanating face faces the opposite side 12.

Figure 3:
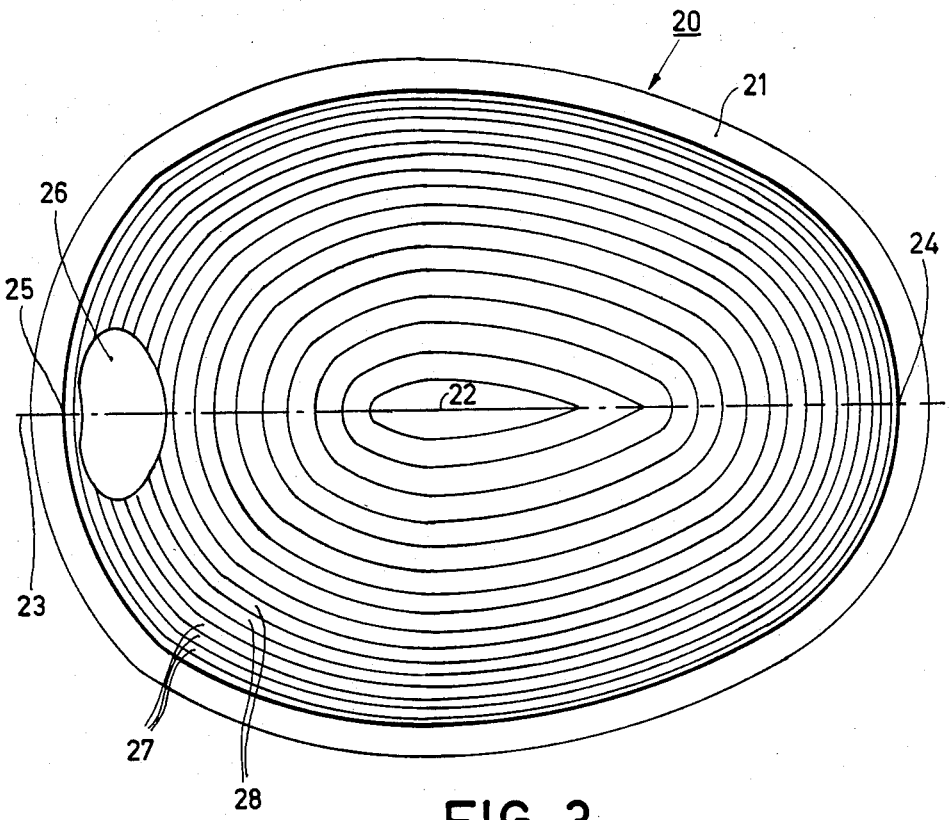

FIG. 3 shows a first embodiment of a dish-shaped reflector 20 for a luminaire according to the invention. The view is from below through the egg-shaped light emanating face bounded by a flat edge 21 of the reflector 20 towards the top 22 of the reflector 20.

The plane of symmetry of the reflector 20 is denoted by 23, the pointed end of the egg-shaped light emanating face by 24, the blunt end by 25. The reflector 20 has an aperture 26 for receiving a lamp holder. The reflector comprises a large number of elongate facets 27, 28 which are curved concave longitudinally and which in addition are curved concave transversely, which is not visible in the drawing, the facets 27 being wider and having a larger radius of transverse curvature than the facets 28.

Figure 4:
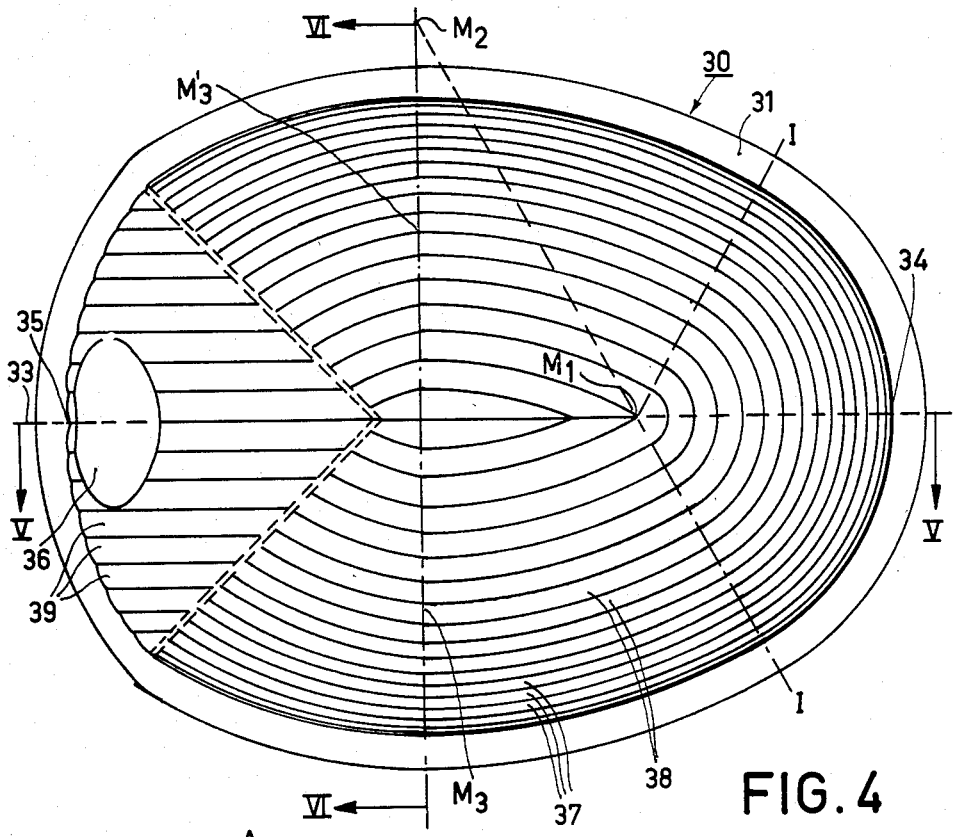

Reference numerals 30 to 38 in FIG. 4 denote parts which correspond to parts which are denoted in FIG. 3 by 20 to 28. From the pointed end 34 of the egg-shaped light emanating face bounded by the edge 31, the elongate facets 27, 38 extend with their longitudinal sides parallel to the light emanating face up to the plane VI—VI.

The longitudinal sides of the facets 37, 38 in the sector I, $M_1$, I are arcs of circles having respective centers on the axis $M_1$. In the zone between I, $M_1$, I and VI—VI they are arcs of circles having respective centers on the axis $M_2$ and on a corresponding axis (not shown) which is the mirror image thereof with respect to the plane 33.

The plane VI—VI is perpendicular to the light emanating face and coincides with the largest transverse dimension thereof. Proceeding from the plane VI—VI to the blunt end 35, the longitudinal sides of the facets 37 and 38 approach the light emanating face under an ever increasing angle. The longitudinal sides of the facets are approximately arcs of a circle. The respective center lies on a respective axis which goes from the plane VI—VI, passes through $M_3$ and $M'_3$, respectively, and is perpendicular to the plane of the drawing. The axes lean over and over in the radial plane from that instant according as the arc more approaches the point 35 (see FIG. 7). In the drawing the angle of inclination was finally 5°.

At the blunt end 35 of the light emanating face elongate facets 39 extend with their longitudinal sides parallel to the plane of symmetry 33. The facets 39 are curved concave longitudinally and transversely.

Figure 5:
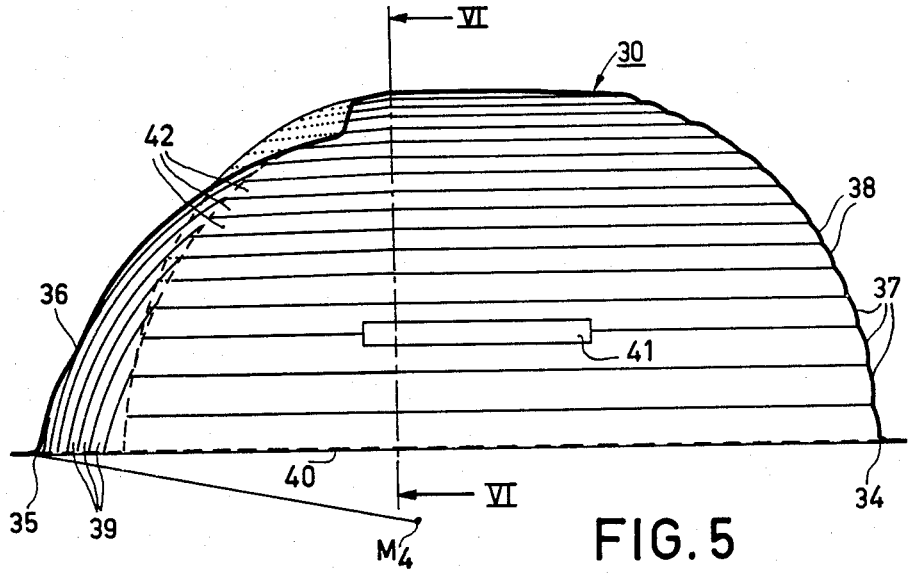
FIG. 5 is a longitudinal sectional view of FIG. 4 taken on the line V—V.
Figure 6:
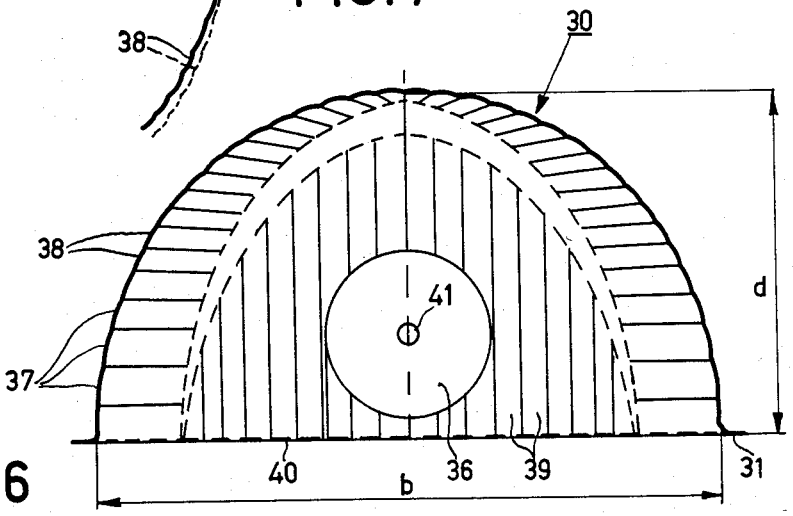
FIG. 6 is a cross-sectional view through FIG. 4 taken on the line VI—VI.

FIGS. 5 and 6 show the reflector 30 of FIG. 4 as a longitudinal sectional view and a cross-sectional view, respectively, and also show an elongate cylindrical light source 41. The light emanating face is denoted by 40. $M_4$ denotes an axis on which the centers of the longitudinal curvature of the facets 39.

The depth d of the dish-shaped reflector 30 (FIG. 6) is 0.55 times the largest transverse dimension b of the light emanating face 40, that is to say that it is within the above-specified range of 0.4 to 0.7.

It can best be seen from FIG. 5 that the facets 37, 38, proceeding from VI—VI to the blunt end 35 of the egg-shaped light emanating face 40, enclose with their longitudinal sides an ever increasing angle with said plane 40. This is best visible for the higher-located facets 42. This measure influences the luminance of the zones 14 in FIG. 2.

The facets 39 visible in FIGS. 4, 5 and 6 are principally of importance for the luminance of the zones 13 on the side 12 of the road situated opposite to the luminaire 1,6 (FIG. 2), in the case where a wider road is to be illuminated.

Figure 7:
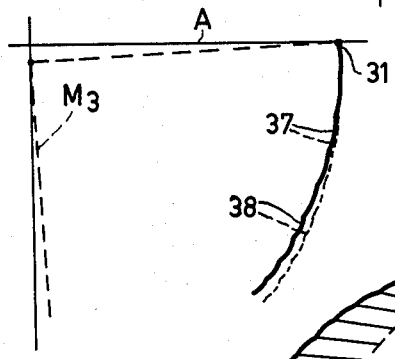
FIG. 7 is an explanatory diagram of a detail of FIG. 4.

In FIG. 7 the axis $M_3$ as well as the facets 37 and 38 are shown in broken lines in the position which they assume in the plane VI—VI (FIG. 4). Proceeding towards the blunt end 35 of the light emanating face the axis $M_3$ has started to lean over more and more, tilting about an arm A which supports against the edge 31 of the reflector 30.

Luminaires having reflectors as shown in FIGS. 4 to 7 and using, for example, a 250 W high-pressure sodium lamp with a bright outer envelope can be placed, for example, at a comparatively large distance from each other and then still produce a very uniform luminance of the illuminated road surface.

I claim:

1. A luminaire for street lighting, comprising both a reflector system having a plane of symmetry and a light emanating face, and a lamp holder for receiving and positioning an associated elongate substantially cylindrical lamp with its axis located in parallel relationship to said plane of symmetry and parallel to the plane of said light emanating face, the reflector system having a reflecting surface at least the major part of which comprises elongate facets extending with their longitudinal sides substantially parallel to the light emanating face, the reflector system comprising a dish-shaped reflector, the light emanating face thereof being generally egg-shaped and whose facets are curved concave longitudinally and transversely, the width of said facets and their radius of transverse curvature being larger the nearer they are to the light emanating face, the depth of the dish-shaped reflector being 0.4 to 0.7 times as large as the largest dimension of the egg-shaped light emanating face, measured transverse to said plane of symmetry, said reflector comprising further facets, also curved transversely and longitudinally, which are located in a sector of the reflector situated at the blunt end of the light emanating face, and which have their longitudinal direction parallel to the plane of symmetry of the reflector.

2. A luminaire for street lighting, comprising both a reflector system having a plane of symmetry and a light emanating face, and a lamp holder for receiving and positioning an associated elongate substantially cylindrical lamp with its axis located in parallel relationship to said plane of symmetry and parallel to the plane of said light emanating face, the reflector system having a reflecting surface at least the major part of which comprises elongate facets extending with their longitudinal sides substantially parallel to the light emanating face, the reflector system comprising a dish-shaped reflector, the light emanating face thereof being generally egg-shaped and whose facets are curved concave longitudinally and transversely, the width of said facets and their radius of transverse curvature being larger the nearer they are to the light emanating face, the depth of the dish-shaped reflector being 0.4 to 0.7 times as large as the largest dimension of the egg-shaped light emanating face, measured transverse to said plane of symmetry, going from said largest transverse dimension towards the blunt end of said face the facets approach with their longitudinal sides the light emanating face of the reflector at an ever increasing angle, the reflector comprises further facets, also curved transversely and longitudinally, which are located in a sector of the reflector situated at the blunt end of the light emanating face, and which have their longitudinal direction parallel to the plane of symmetry of the reflector.

* * * * *